United States Patent [19]

Snyder et al.

[11] 4,274,325

[45] Jun. 23, 1981

[54] SAFING MECHANISM FOR HIGH RATE OF FIRE REVOLVING BATTERY GUN

[75] Inventors: Ronald R. Snyder, Georgia; Lincoln L. Sibley, Jr., South Burlington, both of Vt.

[73] Assignee: General Electric Company, Burlington, Vt.

[21] Appl. No.: 58,359

[22] Filed: Jul. 17, 1979

[51] Int. Cl.[3] ..... F41D 7/04

[52] U.S. Cl. ..... 89/12; 89/148

[58] Field of Search ..... 89/12, 13 R, 11, 148

[56] References Cited

U.S. PATENT DOCUMENTS

| | | | |
|---|---|---|---|
| 125,563 | 4/1872 | Gatling | 89/12 |
| 3,380,341 | 4/1968 | Chiabrandy | 89/12 |
| 3,611,871 | 10/1971 | Kirkpatrick et al. | 89/12 |
| 3,738,221 | 6/1973 | Tan et al. | 89/12 |
| 3,766,821 | 10/1973 | Cozzy et al. | 89/12 |

*Primary Examiner*—David H. Brown

*Attorney, Agent, or Firm*—Bailin L. Kuch

[57] ABSTRACT

A feature of this invention is the provision of a Gatling type gun having a housing; a rotor journaled for rotation with respect to said housing; said rotor having a plurality of gun bolts disposed in an annular row with respective firing pin assemblies, and switchable firing pin assembly control means fixed with respect to said housing for sequentially engaging each of said firing pin assemblies and having a first disposition for positively precluding searing of each firing pin assembly and a second disposition for forcing timely searing of each firing pin; said firing pin assembly control means including a first cam surface having a longitudinally forward, lower portion, and a longitudinally rearward, higher portion which thereafter abruptly falls off into a lacuna; a second cam surface disposed in said lacuna and transversely pivotally mounted and supported for longitudinal movement to and between a first disposition whereat it provides a gradual decline between said higher portion to said lower portion of said first cam surface and a second disposition whereat it provides a gradual return to said lower portion from within said lacuna.

4 Claims, 10 Drawing Figures

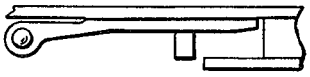
FIG. 1B
FIRE
FIG. 1
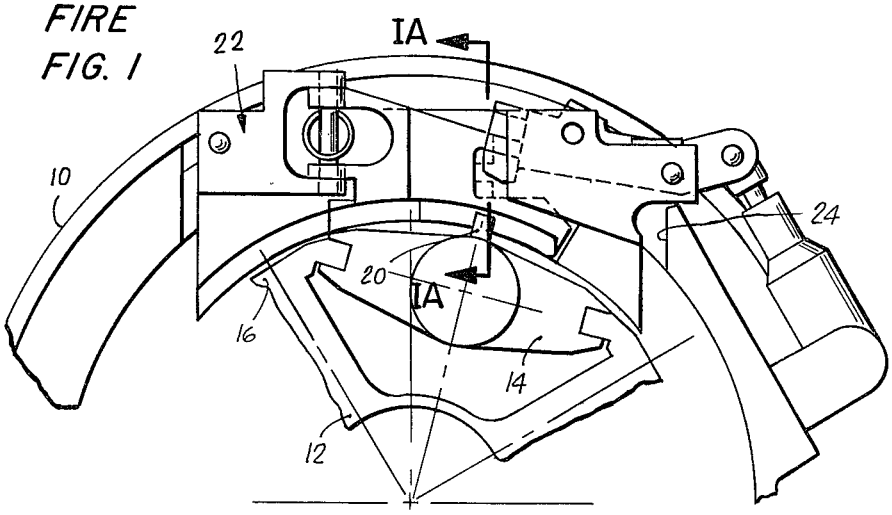
FIG. 1A
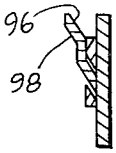
FIG. 2A
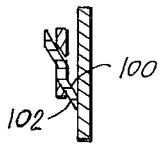
FIG. 2B
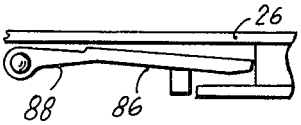
FIG. 2
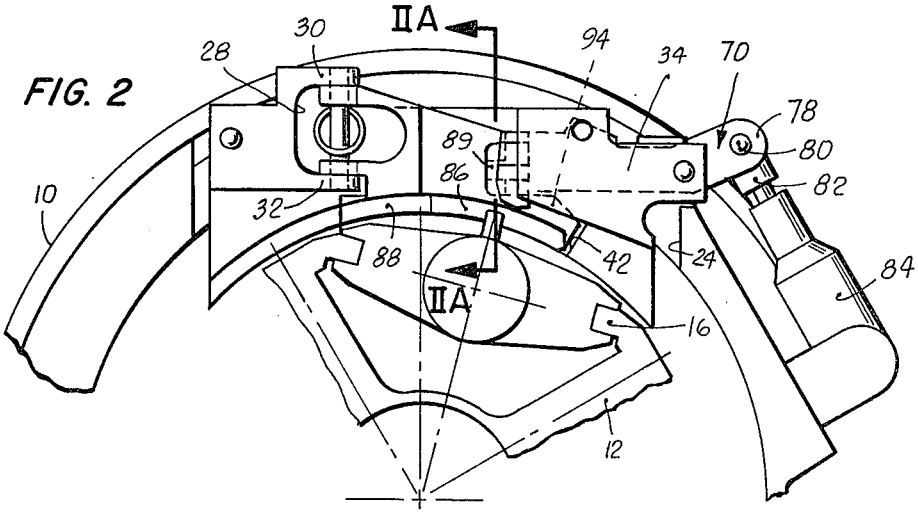

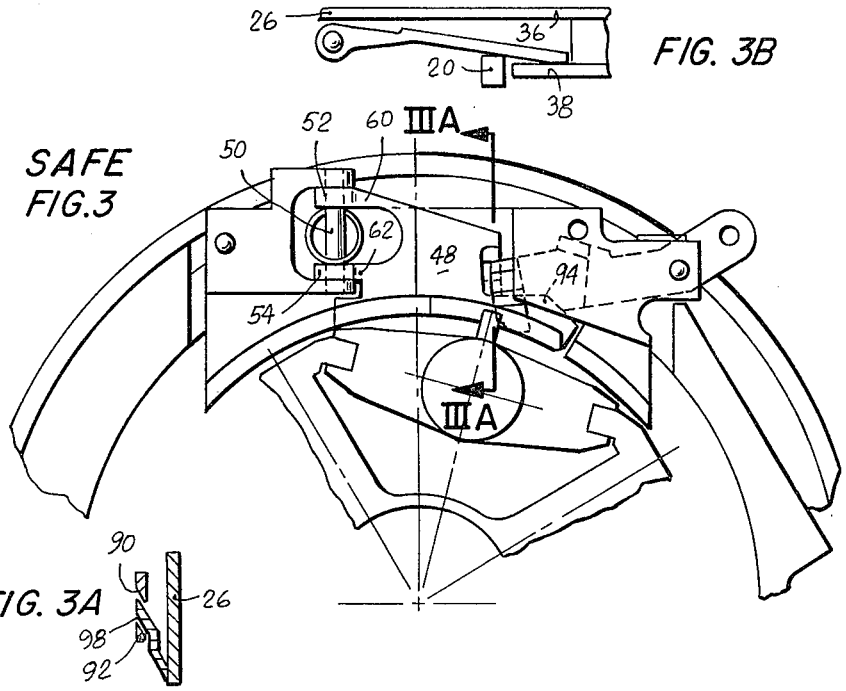
FIG. 3B
SAFE
FIG.3
FIG. 3A
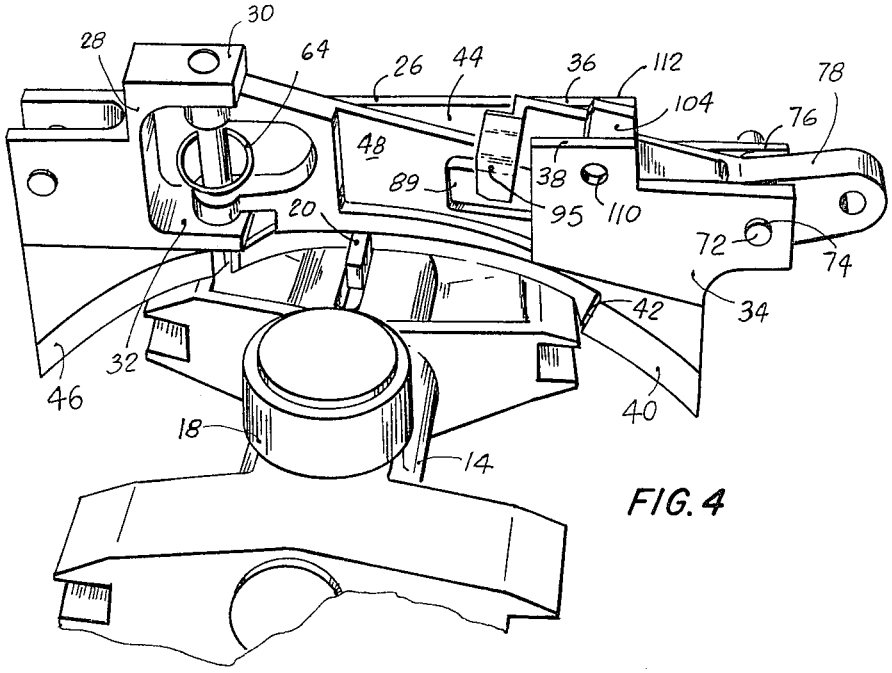
FIG. 4

SAFING MECHANISM FOR HIGH RATE OF FIRE REVOLVING BATTERY GUN

BACKGROUND OF THE INVENTION

1. Field of the Invention

This invention relates to means for positively precluding searing of the firing pins in a Gatling type gun.

2. Prior Art

In U.S. Pat. No. 125,563, issued Apr. 9, 1872 to R. J. Gatling, there is shown the classic modern revolving battery gun. A stationary housing encloses and supports a rotor assembly which has a plurality of gun barrels and a like plurality of gun bolts. Each bolt has its own firing pin and mainspring. Each bolt is traversed longitudinally by a stationary elliptical cam track in the housing. As the bolt is traversed forwardly, its firing pin is captured to the rear by a stationary cam track in the housing, compressing its mainspring until the bolt and the barrel reach the firing position, at which position the stationary cam releases or sears the firing pin to impact the primer of the round.

R. E. Chiabrandy in U.S. Pat. No. 3,380,341, issued Apr. 30, 1968, shows a Gatling type gun having a single mainspring serving each of the plurality of gun bolts. A safing function is provided by a sector of the housing cam track which can be swung away from the bolts and which has a projection to block the mainspring.

R. G. Kirkpatrick et al in U.S. Pat. No. 3,611,871, issued Oct. 12, 1971, shows a Gatling type gun having a plurality of gun bolts and respective mainsprings. Each bolt is traversed longitudinally by a housing elliptical cam, and is rotated into lock by a cam in the aft end of the housing. A positive lock on the firing pin is released by rotating of the bolt into lock. A safing function is provided by shifting the aft cam to preclude rotation of the bolt.

R. M. Tan et al in U.S. Pat. No. 3,738,221, issued June 12, 1973, shows a Gatling type gun having a plurality of gun bolts and respective mainsprings. Each mainspring has a cam follower which engages and rides on a transverse segment of an annular cam to compress the mainspring until it rides off a sharp drop in the cam to actuate the firing pin. A safing element may be swung about an axis which is transverse to the gun longitudinal axis and substantially tangential to the cam into the gap defined by the drop to gradually lower the cam follower and decompress the mainspring to preclude actuating the firing pin.

In the GAU-8 gun as carried by the A10 aircraft, a cam somewhat similar to that shown by Tan is used. However, the safing element is pivoted about an axis which is parallel to the gun longitudinal axis.

In the cam system of the present GAU-8 gun, should the gun halt with a gun bolt having its cocking pin disposed in the gap defined by the drop in the cam, then the safing element cannot be swung fully into the gap because it is blocked by the cocking pin of the gun bolt. Force applied to the safing element merely tends to squash the cocking pin into the side of the gun bolt.

SUMMARY OF THE INVENTION

It is an object of this invention to provide a cam system for a Gatling type gun wherein the safing element is able to displace any cocking pin of a gun bolt which may be disposed in the gap defined by the drop in the cam.

Another object is to provide such a cam system wherein the safing element may be shifted between a safe to a fire disposition and which will self lock itself in each such disposition.

A feature of this invention is the provision of a Gatling type gun having a housing; a rotor journaled for rotation with respect to said housing; said rotor having a plurality of gun bolts disposed in an annular row with respective firing pin assemblies, and switchable firing pin assembly control means fixed with respect to said housing for sequentially engaging each of said firing pin assemblies and having a first disposition for positively precluding searing of each firing pin assembly and a second disposition for forcing timely searing of each firing pin; said firing pin assembly control means including a first cam surface having a longitudinally forward, lower portion, and a longitudinally rearward, higher portion which thereafter abruptly falls off into a lacuna; a second cam surface disposed in said lacuna and transversely pivotally mounted and supported for longitudinal movement to and between a first disposition whereat it provides a gradual decline between said higher portion to said lower portion of said first cam surface and a second disposition whereat it provides a gradual return to said lower portion from within said lacuna.

DESCRIPTION OF THE DRAWING

These and other objects, features and advantages of the invention will be apparent from the following specification thereof taken in conjunction with the accompanying drawing in which:

FIG. 1 is a partial transverse view through a Gatling type gun having a safing mechanism embodying this invention; showing the safing element in its withdrawn or fire, locked, disposition;

FIG. 1A is a section taken along the line IA—IA of FIG. 1;

FIG. 1B is a top view of a detail of FIG. 1;

FIG. 2 is a view similar to FIG. 1, showing the safing element in its intermediate, unlocked, disposition;

FIG. 2A is a section taken along the line IIA—IIA of FIG. 2;

FIG. 2B is a top view of a detail of FIG. 2;

FIG. 3 is a view similar to FIG. 1, showing the safing element in its projected, locked, disposition;

FIG. 3A is a section taken along the line IIIA—IIIA of FIG. 3;

FIG. 3B is a top view of a detail of FIG. 3; and

FIG. 4 is a perspective view of the safing mechanism and gun bolt of FIG. 1.

DESCRIPTION OF THE PREFERRED EMBODIMENT

The Gatling type gun includes a stationary housing 10, in which is journaled a rotor 12 having a plurality of gun bolts 14 which slide on tracks 16 fixed to the rotor. Each bolt has a roller 18 which rides in a helical cam track in the housing, so that as the rotor 12 turns, each bolt 14 is traversed fore and aft on its tracks. Each bolt also has a firing pin with a respective mainspring. The firing pin has a respective cocking pin 20 standing up through a slot in the bolt.

The safing mechanism 22 is fixed in the housing in a transversely extending slot 24 therein.

The safing mechanism includes a main frame 26 which has an aft facing clevis 28 formed of two aftwardly directed lugs 30 and 32, and an outwardly facing clevis 34 formed of two outwardly directed lugs 36 (in the frame) and 38. The frame also includes an aftwardly facing first cam portion 40 having a sharp drop off 42 to the aftwardly facing surface 44 of the main frame 26, and an aftwardly facing second cam portion 46. The first cam portion 40 projects aftwardly much farther than the second cam portion 46, and the two portions mutually define a lacuna.

As the rotor turns, transversely counterclockwise, as seen in the FIGS., it traverses the gun bolt forwardly longitudinally from rear dwell and the firing pin in due course reaches the stationary cam portion 40 and compresses the mainspring as the bolt continues forwardly into forward dwell. The cocking pin also rides transversely counterclockwise across the cam portion 40 towards the drop off.

The safing mechanism also includes a gate element 48 which is disposed within said lacuna and is pivotally mounted for longitudinal movement to the aft facing clevis 28 by means of a pin 50 disposed through a pair of bores 52 and 54 in the lugs 30 and 32 respectively and a pair of bores 56 and 58 in two arms 60 and 62 of the gate. The bore 54 is blind and a ring 64 may be passed through a diametrical bore in the pin to capture it in the bores.

The safing mechanism also includes an actuator element 70 which is pivotally mounted for transverse movement to the outwardly facing clevis 34 by means of a pin 72 disposed through a pair of bores 74 and 76 through the lugs 36 and 38 respectively. The element 70 has a crank arm 78 extending outwardly which is coupled by a pin 80 to a rod 82 of a two position actuator 84 which is fixed to the housing 10 and is remotely controlled. The actuator may be electrical or pneumatic, and is spring loaded to the rod extended position, or normally safe position shown in FIG. 3.

The gate element 48 has a cam surface including a first portion 86 and a second portion 88. The element may be disposed in a first, forward position, as shown in FIG. 1, whereat when the cocking pin 20 of the firing pin longitudinally falls off the longitudinally rearward, higher stationary cam portion 40, at the drop off 42, it falls rapidly under the force of the compressed mainspring of the firing pin, until the firing pin hits the primer of the cartridge case. It remains at this level until it rides longitudinally aftwardly up the ramp of the gate cam portion 88 and thence onto the longitudinally forward, lower stationary cam portion 46. The longitudinal level of the cam portion 40 provides compression of the mainspring. The longitudinal level of the cam portion 86 permits penetration of the firing pin into the primer of the cartridge case. The longitudinal ramp of the cam portion 88 extracts the firing pin from the primer. The longitudinal level of the cam portion 46 maintains the firing pin clear of the cartridge case.

The gate element 48 also includes a predistal notch 89 having an aftwardly facing ramp 90 and a forwardly facing ramp 92, and a tab 94.

The actuator element 70 also includes a distal lug 95 of somewhat Z-shaped configuration having an upper, forwardly facing ramp 96, an upper, aftwardly facing ramp 98, a lower, forwardly facing ramp 100 and a lower, aftwardly facing ramp 102. The element 70 also includes a medial spacer block having a ramp surface 104, and which block rides between the two lugs 36 and 38 and prevents longitudinal deflection of the element. The lug 95 is disposed within the notch 89. In the firing disposition shown in FIG. 1, the actuator element is swung up, with the ramp surface 100 of the actuator wedged against the ramp surface 90 of the gate, locking the gate element forward against the back plate 26. In the safe disposition shown in FIG. 3, the actuator element is swung down, with the ramp surface 98 of the actuator wedged against the ramp surface 92 of the gate, locking the gate element aft, with its tab 94 against the lug 38. In the intermediate disposition shown in FIG. 2, the gate and the actuator are loosely interfitted. These interacting elements of the gate and the actuator may be considered wedge locking means.

A pair of holes 110 and 112 may be provided in the lugs 38 and 44 to admit a pin to block the actuator element on its swung down, safe disposition.

Should the gun be halted with a gun bolt so disposed that its cocking lever rests against the gate cam portion 86, as shown in the FIGS., the gate element 48 can still be swung aftwardly into its safe disposition, as the gate element will merely push the follower aft, compressing the mainspring of the firing pin. This is accomplished by forcing a safing pin through holt 110 which acts on the ramp surface 104 on the actuator element 70 and which forces the actuator element radially inward to the safe position and thus ensures a safe gun regardless of the cocking pin location. The safing pin is conventionally a round rod having a taper on its end which is inserted through the holt 110 to preclude any inadvertent firing while so installed.

We claim:

1. In a Gatling type gun having:

a housing;

a rotor journaled for rotation with respect to said housing along a longitudinal axis;

said rotor having a plurality of gun bolts disposed in an annular row with respective firing pin assemblies; and switchable firing pin assembly control means fixed with respect to said housing for sequentially engaging each of said firing pin assemblies and having a first disposition for positively precluding searing of each firing pin assembly and a second disposition for forcing timely searing of each firing pin, said firing pin assembly control means including first means having a first annular cam surface having a longitudinally forward, lower portion, a longitudinally rearward, higher portion, and therebetween a lacuna in said cam surface, the improvement of:

a second means having a second cam surface disposed in said lacuna and transversely pivotally mounted and actuated for longitudinal movement to and between a first disposition whereat said second cam surface provides a continuum and a gradual decline between said higher portion to said lower portion of said first cam surface, and a second disposition whereat it provides a gradual return to said lower portion of said first cam surface from within said lacuna.

2. In a Gatling type gun according to claim 1 wherein each of said firing pin assemblies includes a cocking lever and a firing pin spring, and said higher portion, said lacuna and said lower portion are each adapted to receive each of said cocking levers in turn, and wherein during rotation of said rotor each gun bolt is traversed longitudinally forwardly to abut its respective cocking lever against said higher portion of said first cam surface to compress said firing pin spring while traveling transversely towards said lacuna, the improvement wherein should said gun bolt be halted with said second means disposed in said second disposition and said respective cocking pin disposed in said lacuna, said second means is so constructed and arranged as to be movable from said first disposition to said second disposition, said second cam surface moving said cocking pin therewith.

3. In a Gatling type gun according to claim 1 the improvement of wedge locking means for locking said second means in either said first disposition or said second disposition.

4. In a Gatling type gun according to claim 1 the improvement of an actuator arm longitudinally pivotally mounted for shifting said second means to and between said first and second disposition said actuator arm and said second means having interlocking camming and wedging surfaces.

* * * * *